US007065797B1

(12) United States Patent
Chen

(10) Patent No.: US 7,065,797 B1
(45) Date of Patent: Jun. 27, 2006

(54) BRIEFS

(75) Inventor: Shyan-Wei Chen, Taipei Hsien (TW)

(73) Assignee: Racer Sporting Goods Co., Ltd., Taipei Hsien (TW)

( * ) Notice: Subject to any disclaimer, the term of this patent is extended or adjusted under 35 U.S.C. 154(b) by 286 days.

(21) Appl. No.: 10/625,517

(22) Filed: Jul. 24, 2003

(51) Int. Cl.
*A41B 9/00* (2006.01)

(52) U.S. Cl. ..... 2/400; 2/403

(58) Field of Classification Search ..... 2/400–408, 2/227, 228, 238, 67; 604/385.3, 385.31, 604/393–402
See application file for complete search history.

(56) References Cited

U.S. PATENT DOCUMENTS 3,283,545 A * 11/1966 Simon ..... 66/177
3,354,880 A * 11/1967 Coughlin ..... 602/67
3,499,442 A * 3/1970 Steinmetz ..... 602/67
4,173,976 A * 11/1979 Bloomquist et al. ..... 602/67
5,157,793 A * 10/1992 Michels ..... 2/403
6,289,520 B1 * 9/2001 Page ..... 2/403

* cited by examiner

*Primary Examiner*—Gloria M. Hale
(74) *Attorney, Agent, or Firm*—Troxell Law Office, PLLC

(57) ABSTRACT

A pair of briefs in which a front outer panel has a seam smoothly curved and vertically extended between a top and a bottom at a middle section and a convex portion formed at a middle area of the seam; a front inner panel has a first seam smoothly curved and vertically extending downwardly from a middle of a top, a second seam smoothly curved and vertically extending upwardly from a middle of a bottom in line with the first seam, and a convex portion formed at a center between the first seam and the second seam corresponding to the convex portion of the front outer panel for accommodating the user's external genial organs comfortably.

4 Claims, 6 Drawing Sheets

BRIEFS

BACKGROUND AND SUMMARY OF THE INVENTION

The present invention relates to underwear and, more particularly, to a pair of briefs for man, which fits the curvature of the male's external genital organs, giving comfortable wear.

FIG. 1 shows a pair of briefs 5 for man according to the prior art. According to this design, the pair of briefs 5 is not elastic. When put on the user's body, the does not expand and contract following the movement of the user's body. Therefore, this design of briefs is not comfortable in use. FIG. 2 shows another structure of briefs 6 for man according to the prior art. According to this design, the pair of briefs 6 comprises a briefs body 62 made of elastic fabric, and a waistband 61 provided around the top of the briefs body 62. This design of briefs is still not comfortable in wear because the waistband 61 and the briefs body 62 have a different elastic ratio.

The present invention has been accomplished to provide a pair of briefs, which eliminates the drawbacks of the conventional briefs. It is one object of the present invention to provide a pair of briefs for man, which gives comfortable wear. It is another object of the present invention to provide a pair of briefs for man, which has means to receive and support the user's external genital organs comfortably.

According to one aspect of the present invention, the pair of briefs is comprised of a base panel, a front outer panel, a front inner panel, and a waistband. The front outer panel has a seam smoothly curved and vertically extended between the top and bottom sides on the middle and a convex portion formed around a middle area of the seam. The front inner panel has a first seam smoothly curved and vertically downwardly extended from the midpoint of the top side, a second seam smoothly curved and vertically upwardly extended from the midpoint of the bottom side in line with said first seam, and. a convex portion formed around the middle part between the first seam and the second seam corresponding to the convex portion of the front outer panel for accommodating the user's external genial organs comfortably. According to another aspect of the present invention, the waistband, the base panel, the front outer panel, and the front inner panel have same elastic ratio.

DETAILED DESCRIPTION OF THE INVENTION

Figure 1:
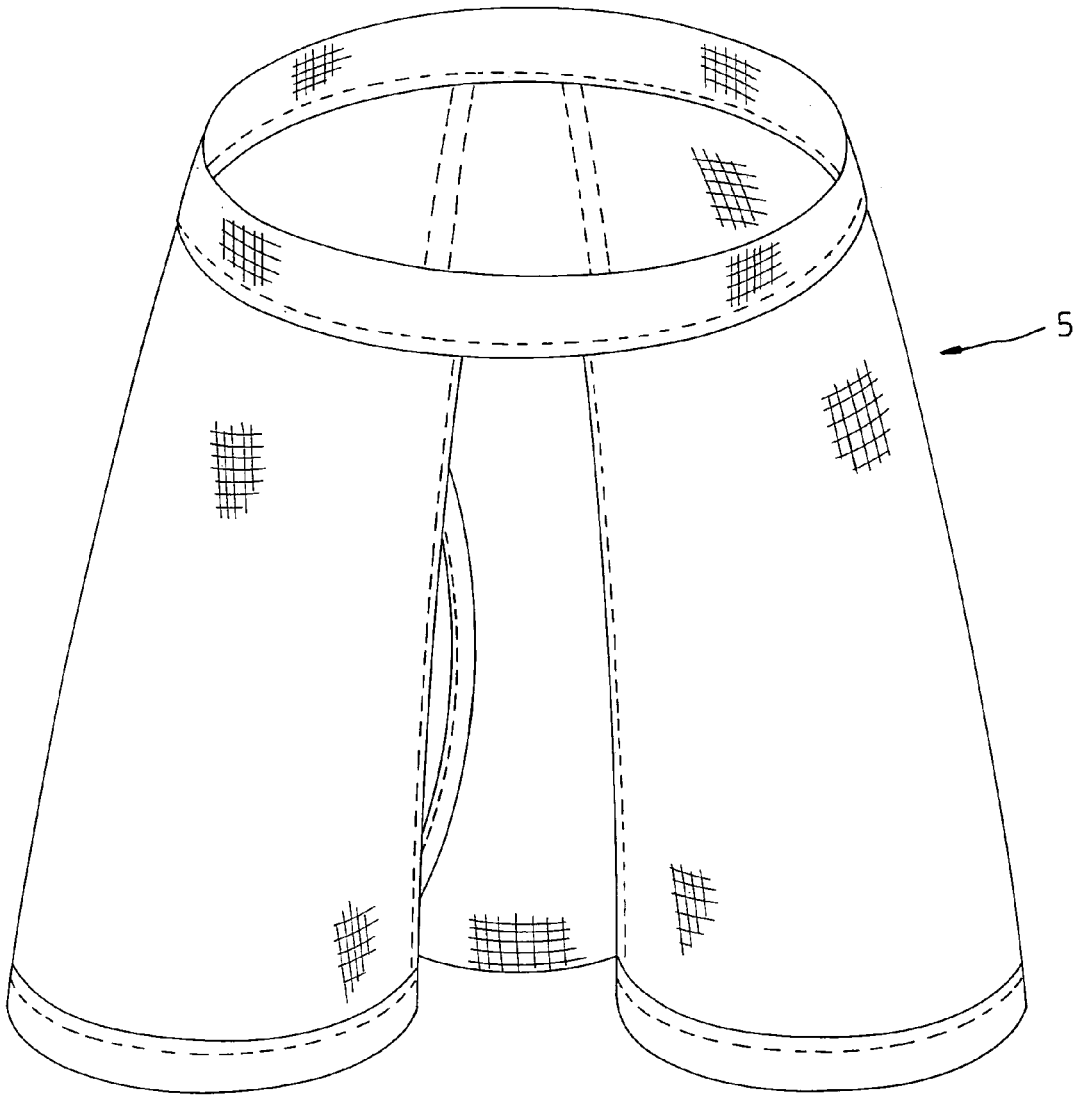
Fig. 1 PRIOR ART
FIG. 1 is a perspective view of a pair of briefs for man according to the prior art.
Figure 2:
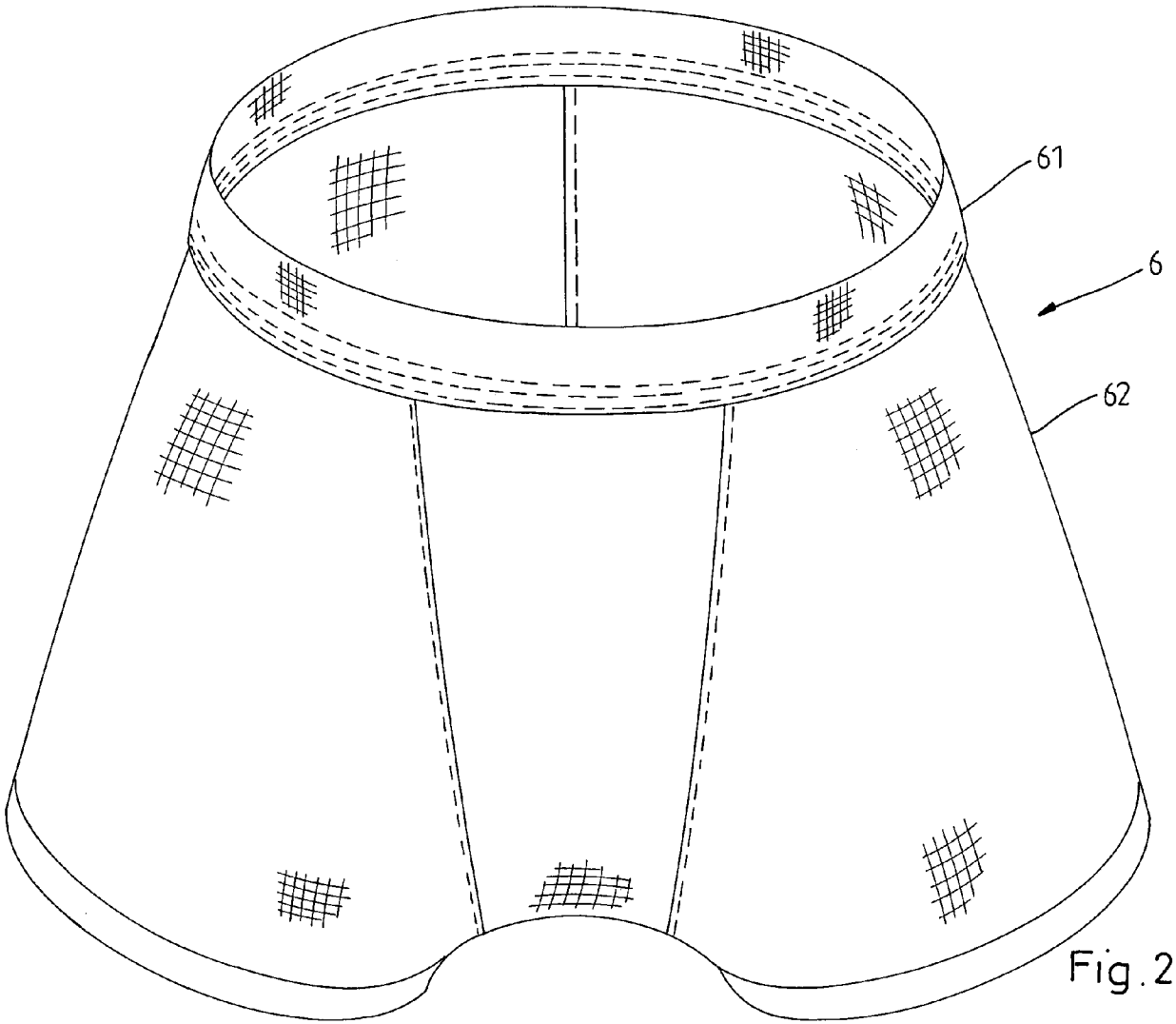
Fig. 2 PRIOR ART
FIG. 2 is a perspective view of another pair of briefs for man according to the prior art.
Figure 3:
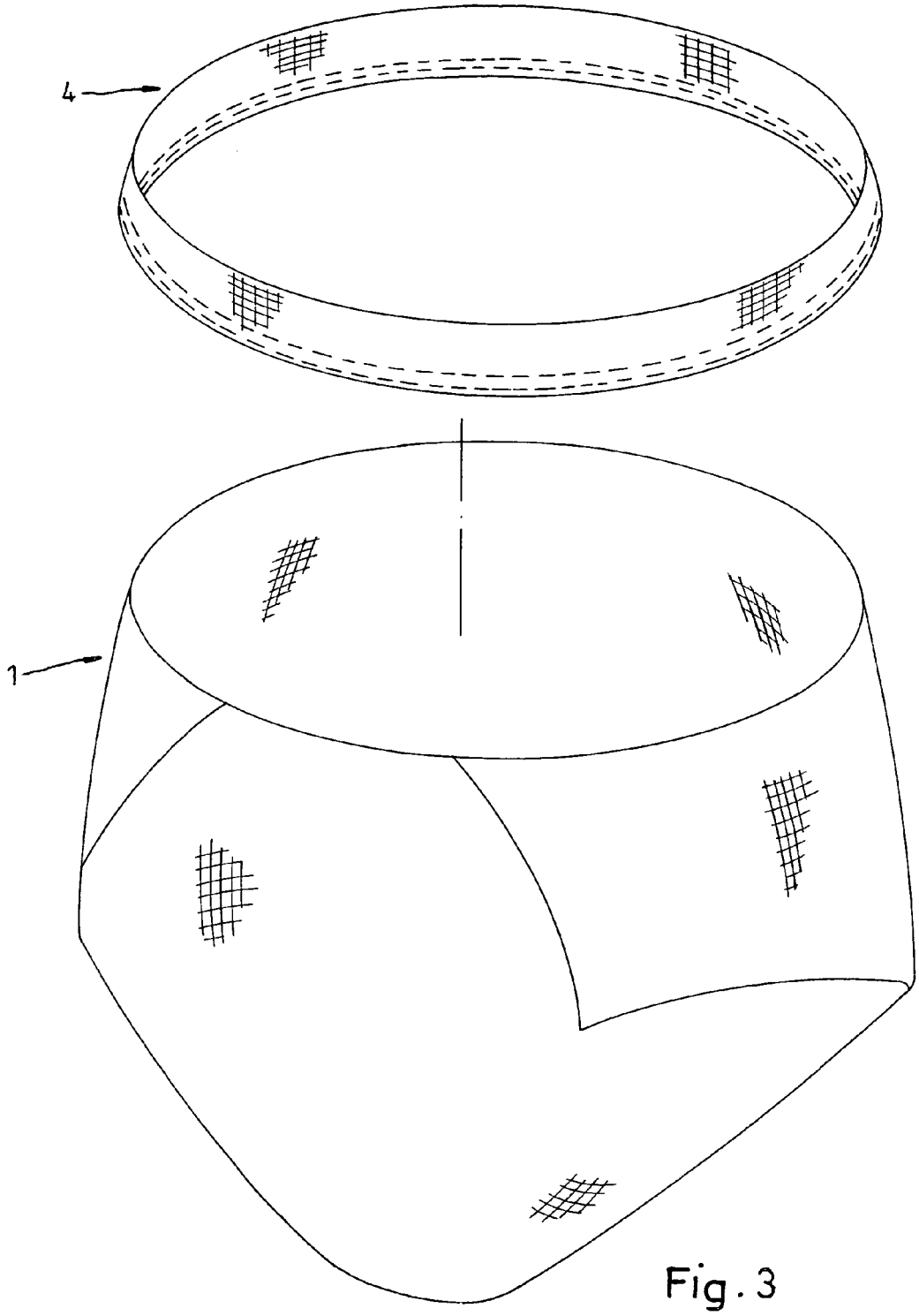
FIG. 3 is an exploded view of a base panel and a waistband for a pair of briefs according to the present invention.
Figure 4:
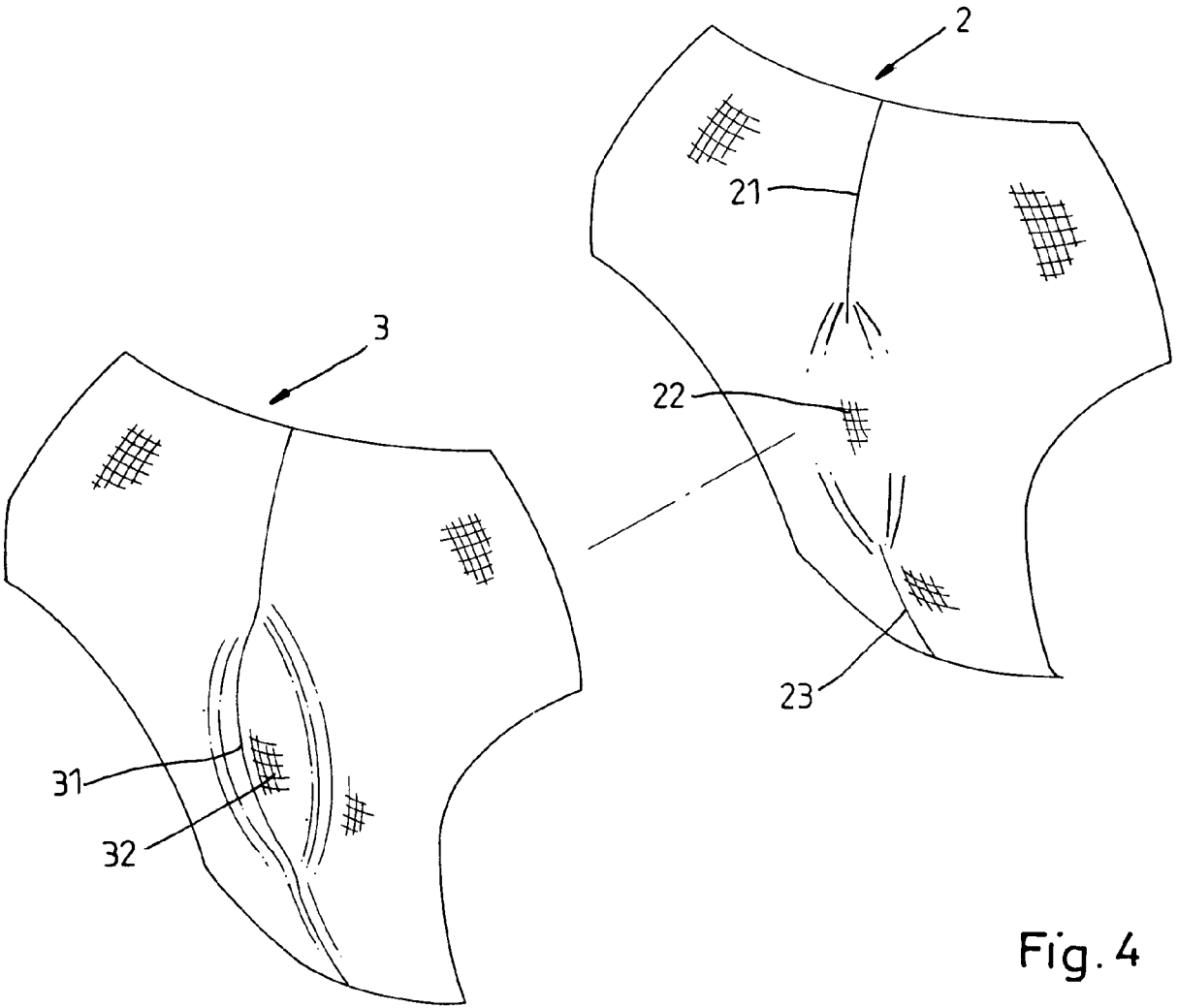
FIG. 4 is an exploded view of a front outer panel and a front inner panel for a pair of briefs according to the present invention.
Figure 5:
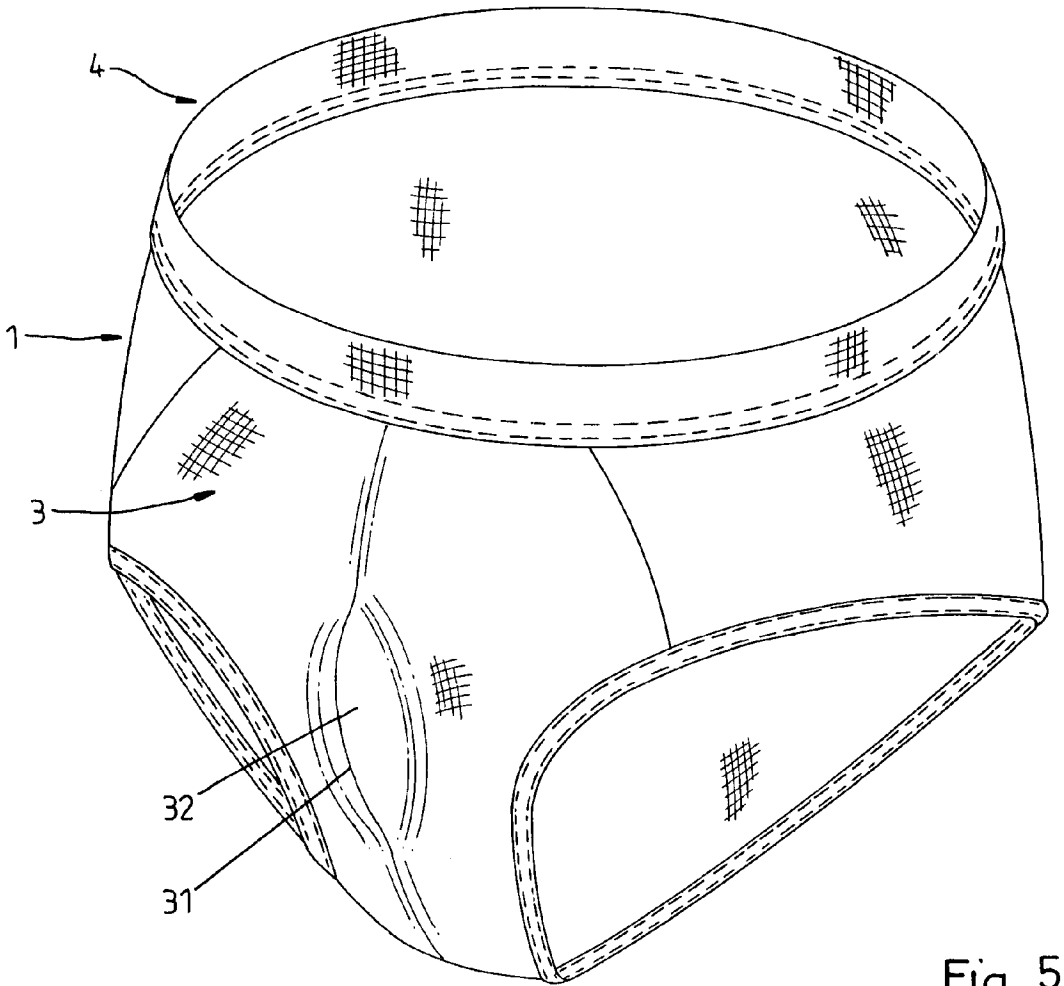
FIG. 5 is a perspective view of a pair of briefs according to the present invention.

Referring to FIGS. 3~5, a pair of briefs in accordance with the present invention comprising a base panel 1, a front inner panel 2 fastened to the base panel 1 at the front side, a front outer panel (fly) 3 fastened to the base panel 1 in front of the front inner panel 2, and a waistband 4 fastened to the base panel 1, the front inner panel 2 and the front outer panel 3 around the top. The base panel 1, the front inner panel 2, and the front outer panel 3 are made of elastic fabric, for example, spandex. The overlapped area of the front inner panel 2 and the front outer panel 3 is sufficient to cover the external genital organs of a man.

The main features of the present invention are outlined hereinafter. The base panel 1, the front inner panel 2, the front outer panel 3, and the waistband 4 have the same elastic ratio, The front outer panel 3 has a seam 31 vertically extended and smoothly curved on the middle, thereby forming a convex portion 32 around the middle area of the front outer panel 3. The front inner panel 2 has a first seam 21 smoothly curved and vertically downwardly extended from the midpoint of the top side, a second seam 23 smoothly curved and vertically upwardly extended from the midpoint of the bottom side. The first seam 21 and the second seam 23 are spaced from each other at a distance and aligned in a line, thereby causing a convex portion 22 formed around the middle area of the front inner panel 2. When the front inner panel 2 and the front outer panel 3 attached together and stitched to the base panel 1 and the waistband 4, the convex portion 32 of the front outer panel 3 is suspended in front of the convex portion 22 of the front inner panel 2. When the briefs put worn on the user's body, the convex portions 22 and 32 receive and support the user's penis comfortably. Because the convex portion 22 is seamless and because the base panel 1, front inner panel 2, front outer panel 3, and waistband 4 of the briefs have the same elastic ratio, wearing the briefs is comfortable.

Figure 6:
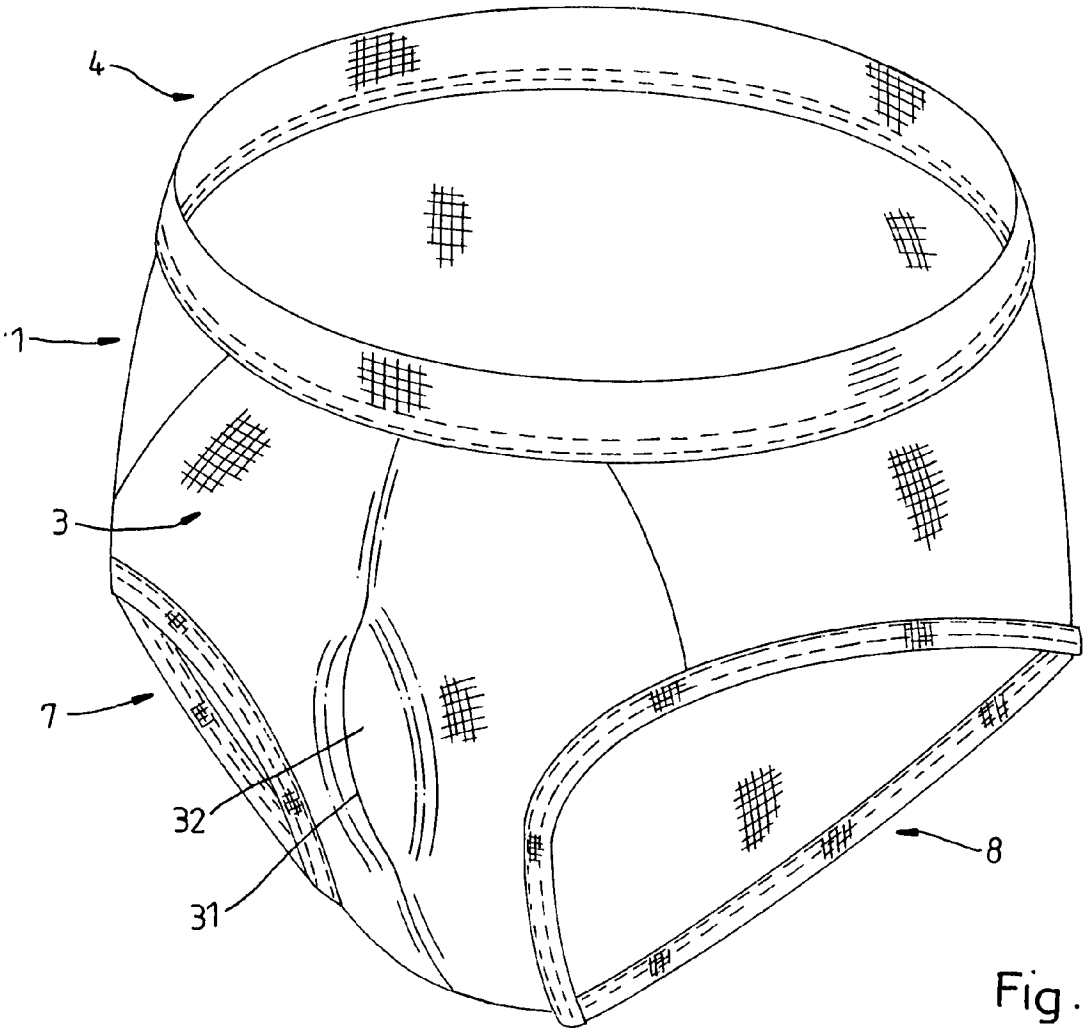
FIG. 6 is a perspective view of an alternate form of the briefs according to the present invention.

FIG. 6 shows an alternate form of the briefs. According to this alternate form, two thigh bands 7 and 8 are bilaterally fastened to the base panel 1, the front inner panel 2, and the front outer panel 3, forming two leg holes for the legs. The thigh bands 7 and 8 have the same elastic ratio like the base panel 1, the front inner panel 2, the front outer panel 3, and the waistband 4.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A pair of briefs comprising a base panel, a front inner panel fastened to a front side of said base panel, a front outer panel fastened to said base panel in front of said front inner panel, and a waistband fastened to tops of said base panel, said front inner panel and said front outer panel, said base panel, said front outer panel and said front inner panel being respectively made of elastic fabric;

wherein said front outer panel has a seam smoothly curved and vertically extending between the top and a bottom and located on a midsection thereof, and a convex portion formed around a middle area of the seam of said front outer panel; said front inner panel has a first seam smoothly curved and vertically extending downwardly from a middle of the top thereof, a second seam smoothly curved and vertically extending from a middle of a bottom thereof in line with said first seam and spaced from said first seam at a distance, and a convex portion formed at a center thereof between said first seam and said second seam corresponding to the convex portion of said front outer panel for accommodating the user's external genial organs.

2. The pair of briefs as claimed in claim 1, wherein said base panel, said front outer panel, said front inner panel, and said waistband have the same elastic ratio.

3. The pair of briefs as claimed in claim 1, further comprising two thigh bands bilaterally fastened to said base panel, said front outer panel and said front inner panel, forming two elasticized leg holes for the legs.

4. The pair of briefs as claimed in claim 1, wherein said thigh bands have the same elastic ratio like said base panel, said front outer panel, said front inner panel, and said waistband.

* * * * *